US008067694B2

(12) United States Patent
Patel et al.

(10) Patent No.: US 8,067,694 B2
(45) Date of Patent: Nov. 29, 2011

(54) HIGH VOLTAGE CABLE

(75) Inventors: Poorvi Patel, Ballwin, MO (US); Birgitta Källstrand, Västerås (SE); Michal Ciach, Kraków (PL); Elisabeth Strandemo, Karlskrona (SE); Ulf Öberg, Lycekeby (SE); Tommy Johansson, Bräkne-Hoby (SE); Carl-Olof Olsson, Västerås (SE)

(73) Assignee: Abb Research Ltd., Zürich (CH)

( * ) Notice: Subject to any disclaimer, the term of this patent is extended or adjusted under 35 U.S.C. 154(b) by 342 days.

(21) Appl. No.: 12/513,434

(22) PCT Filed: Oct. 18, 2007

(86) PCT No.: PCT/SE2007/050753

§ 371 (c)(1),
(2), (4) Date: May 4, 2009

(87) PCT Pub. No.: WO2008/054307

PCT Pub. Date: May 8, 2008

(65) Prior Publication Data

US 2010/0078195 A1 Apr. 1, 2010

(30) Foreign Application Priority Data

Nov. 3, 2006 (SE) ..... 0602332

(51) Int. Cl.
*H01B 5/08* (2006.01)

(52) U.S. Cl. ..... 174/126.1; 174/128.1; 174/129 R; 29/825; 29/828

(58) Field of Classification Search ..... 174/102 R, 174/106 R, 108, 109, 126.1, 128.1, 129 R, 174/133 R; 29/825, 828
See application file for complete search history.

(56) References Cited

U.S. PATENT DOCUMENTS

| | | | | |
|---|---|---|---|---|
| 1,943,087 | A * | 1/1934 | Potter et al. | 174/107 |
| 3,164,670 | A * | 1/1965 | Sigmund | 174/128.1 |
| 3,823,542 | A * | 7/1974 | Pemberton | 57/15 |
| 5,496,969 | A * | 3/1996 | Blackmore | 174/113 R |
| 5,554,826 | A * | 9/1996 | Gentry | 174/128.1 |
| 7,228,627 | B1 * | 6/2007 | Yoshimura et al. | 29/872 |
| 2008/0156525 | A1 * | 7/2008 | Deve et al. | 174/45 TD |

OTHER PUBLICATIONS

PCT/ISA/210—International Search Report—Jan. 25, 2008.
PCT/IPEA/409—International Preliminary Report on Patentability—Oct. 2, 2008.

* cited by examiner

*Primary Examiner* — William Mayo, III
(74) *Attorney, Agent, or Firm* — Venable LLP; Eric J. Franklin

(57) ABSTRACT

An extruded high voltage cable including a conductor with at least three concentric layers of helically wound metal wires, an extruded inner conducting layer surrounding the conductor, and an extruded electrical insulation arranged outside the inner conducting layer. The two outermost layers of the conductor have the same lay direction.

12 Claims, 2 Drawing Sheets

HIGH VOLTAGE CABLE

CROSS-REFERENCE TO RELATED APPLICATIONS

This application claims priority to Swedish patent application 0602332-9 filed 3 Nov. 2006 and is the national phase under 35 U.S.C. §371 of PCT/SE2007/050753 filed 18 Oct. 2007.

TECHNICAL FIELD

The present invention relates to an extruded high voltage cable comprising a conductor with at least three concentric layers of helically wound metal wires, an extruded inner semiconducting layer surrounding the conductor, and an extruded electrical insulation. The inventions also relates to a method for manufacturing a high voltage cable.

BACKGROUND ART

An extruded high voltage cable generally comprises a conductor, a first conducting layer arranged around the conductor, an insulation layer comprising a polymer arranged concentrically around the first conducting layer and a second conducting layer arranged around the insulation layer. Usually there are also protective layers arranged concentrically around the second conducting layer. The polymer in the insulating layer generally is a cross-linked polymer, for example, polyethylene, ethylene-propylene rubber (EPM, EPDM) or silicone rubber. The conducting layers are usually made of one of the above mentioned polymers and carbon black. Sometimes a longitudinal semiconducting tape is arranged between the conductor and the first conducting layer to prevent material from the first conducting layer to be pushed into gaps between adjacent wires in the conductor. The longitudinal tape is, for example, made of polyester and carbon black and has a width that is a greater than the circumference of the conductor.

A conductor for an extruded high voltage cable is usually made either by arranging a plurality of metal wires in segments, a so-called segmented conductor, or by stranding together a plurality of metal wires in concentric layers, a so-called concentric lay conductor.

The geometry of a concentric lay conductor may, for example, be arranged according to the following: Six wires are firmly arranged around a single central wire in a first layer. A second layer comprising 12 wires is concentrically arranged around the first layer. A third layer comprising 18 wires is concentrically arranged around the second layer, etc. Each layer has six wires more than the underlying layer. The number of layers in a concentric lay conductor is decided with regard to the required current of the cable. There exist several standards regarding the number of wires in the different layers. Usually the wires of the second, third and each consecutive layer are helically wound around the preceding layer. Instead of a central wire with six surrounding wires in a first layer, a solid conductor or a hollow conductor may, for example, be used.

Arranging the wires in concentric layers creates interstices in the conductor, and the conductor is therefore compacted to increase the fraction of metal in the conductor cross section and to reduce the diameter of the conductor. This compacting is usually made for each layer of wires by a wire drawing type die or by rollers. The compacting could also be done for the complete conductor after the outermost layer has been laid.

For the manufacturing of an extruded high voltage cable the next step after the conductor has been made is to extrude the conducting layers and the insulation layer concentrically around the conductor. The compacted conductor is usually wound on a cable drum and transported to the extrusion line. In a step before the extrusion a longitudinal semiconducting tape may be folded around the conductor to prevent material from the inner conducting layer to be pushed into gaps between adjacent wires in the outer layers of the conductor. The extrusion is made in an extrusion line, where the conductor is fed into an extrusion head where usually the inner conducting layer, the insulation layer, and the outer conducting layer are extruded around the conductor in the same operation step.

During extrusion of the inner conducting layer it is important for the outer layer of the conductor to be tight, i.e. that there are no gaps between adjacent wires in the outer layer. This is especially the case for conductors with a large cross section, as for example between 800-3000 $mm^2$. If a loose conductor, i.e. where the outer layer is not tight, is fed to the crosshead of the extrusion line, the outer layer of the conductor may be pushed backwards by the crosshead and when the diameter becomes too large for the crosshead, the outer layer will get stuck and a so-called "bird-cage" structure will be formed in a short time. If this is the case the extrusion line must be stopped immediately. The conductor is exposed to bending when it is transported from the wire drawing machine and after extrusion when the cable is wound on a cable drum.

Occasionally a loose conductor can be run through the extrusion line without an immediate problem, and without being discovered. The inner interface of the inner conducting layer may become irregular due to gaps between adjacent wires in the outer layer of the conductor. This may cause an increase of the electric field at the interface and may result in electrical breakdown at high voltage testing of the cable.

To minimize the risk of a loose conductor getting stuck in the extrusion die, the outer surface of the conductor is usually helically wound with a semiconducting tape before the extrusion, or larger tolerances is allowed for the crosshead in the extrusion line, than what would have been necessary if the risk of having a loose conductor would be very low. Large tolerances for the cross head might give a cable where the centering of the conductor in the cable is not as good as if the tolerances of the crosshead would not need to be increased due to the risk of a loose conductor.

SUMMARY OF THE INVENTION

An object of the invention is to provide an improved extruded high voltage cable and method of producing an extruded high voltage cable.

According to a first aspect of the present invention there is provided an extruded high voltage cable comprising a conductor with at least five concentric layers of helically wound metal wires, wherein the two outermost layers of the conductor have the same lay direction, wherein a length of the layer of the outermost layer of the conductor is shorter than a length of lay of the second outermost layer of the conductor and wherein a difference between the length of lay of the outermost layer of the conductor and the length of lay of the second outermost layer of the conductor is greater than or equal to two times an outer diameter of the conductor.

According to one embodiment of the invention an extruded high voltage cable comprises a conductor with at least three concentric layers of helically wound metal wires. An extruded inner conducting layer surrounds the conductor and an extruded electrical insulation is arranged outside the inner conducting layer. The two outermost layers of the conductor have the same lay direction.

The "lay direction" is the helical direction in which the metal wires are wound in each layer. The lay direction can be a right-hand lay or a left-hand lay.

An extruded high voltage cable comprising a conductor having the same lay direction in the two outermost layers provides a surface of the conductor that is tight and smooth in order to provide good conditions for the extruded inner conducting layer and the electrical insulation layer. This makes it possible for the conductor to enter the crosshead of the extrusion line without the requirement of taping the outermost layer with conductor tape, which leads to a manufacturing of the cable that is cost effective. Further, it minimizes the risk of an increase of the electric field at the interface between the outer surface of the conductor and the electrical insulation.

According to one embodiment of the invention the length of lay of the outermost layer is shorter than the length of lay of the second outermost layer. This further improves the characteristics of the conductor surface and the interface between the conductor and the insulation of the cable.

The "length of lay" is the distance along the conductor and parallel to the longitudinal axis of the conductor that it takes for a metal wire in the conductor to make one turn around the conductor axis.

According to one embodiment of the invention the length of lay of the outermost layer is shorter than the length of lay of the second outermost layer, and the difference between the length of lay of the outermost layer and the length of lay of the second outermost layer is greater than, or equal to, two times the outer diameter of the conductor. It has been found that this gives an outer surface of the conductor with further improved surface characteristics. This will also avoid problems with wires from outermost layer falling down into the second outermost layer when the conductor is manufactured.

According to one embodiment of the invention at least one of the layers positioned inside the two outermost layers in the conductor is arranged with a lay direction in an opposite direction to the lay direction of the two outermost layers. When arranging one of the layers underlying the two outer layers in an opposite direction to the two outermost layers, the torsion properties during axial loading are improved.

According to one embodiment of the invention the conductor comprises at least five concentric layers of helically wound metal wires, and the conductor has a cross section area greater than 700 $mm^2$. For conductors larger than 700 $mm^2$ the arrangement of the two outermost layers of the conductor in the same direction gives a considerable cost saving because it is not necessary to use a layer of tape on the outer surface of the conductor to have a conductor with sufficient surface characteristics, i.e. with a tight outermost layer of the conductor, for the extrusion process.

According to one embodiment the conductor has a cross section area between 800 $mm^2$ and 3000 $mm^2$.

According to one embodiment of the invention the inner semiconducting layer is arranged directly and in contact with the outermost layer of the conductor.

According to one embodiment of the invention the inner semiconducting layer is arranged directly on a longitudinal semiconducting tape arranged in contact with and around the outermost layer of the conductor. This gives a considerable cost saving compared to using helical taping with conductor tape to keep the conductor wires together and to achieve a smooth outer surface of the conductor before the insulation system is extruded on the conductor.

The material of the conductor is, for example, copper or aluminum. The material of the insulation comprises, for example, cross-linked polyethylene, cross-linked ethylene-propylene rubber (EPM, EPDM) or silicone rubber.

According to a second aspect of the invention there is provided a method for manufacturing a high voltage cable comprising helically winding a conductor of at least five layers of helically metal wires, winding the conductor such that the two outermost layers of metal wires are wound in a same lay direction, and helically winding the two outermost layers of the conductor such that a length of the outermost layer is shorter than a length of lay of the second outermost layer of the conductor and winding the two outermost layers of the conductor such that a difference between the length of lay of the outermost layer of the conductor and the length of lay of the second outermost layer of the conductor is greater than or equal to two times an outer diameter of the conductor.

According to one embodiment of the invention the manufacturing of an extruded high voltage cable comprises manufacturing a conductor by helically winding at least three layers of metal wires around a central conductor, winding the layers of metal wires such that the two outermost layers are wound in the same lay direction. An inner conducting layer is extruded around the outer surface of the conductor, such that it surrounds the conductor, and an insulation layer is arranged outside and circumferential to the inner conducting layer.

According to an embodiment of the invention the method comprises compacting the conductor such that the diameter of the conductor is decreased. The compacting gives a dense conductor with an increased fraction of metal in the conductor cross section.

According to an embodiment of the invention the method comprises helically winding the two outermost layers of the conductor such that the length of lay of the outermost layer is shorter than the length of lay of the second outermost layer.

According to an embodiment of the invention the method comprises winding the two outermost layers of the conductor such that the length of lay of the outermost layer is shorter than the length of lay of the second outermost layer and that the difference between the length of lay (L2) of the outermost layer (3) and the length of lay (L1) of the second outermost layer (4) is greater than, or equal to, two times the outer diameter (D) of the conductor.

According to an embodiment of the invention the method comprises winding at least one of the layers positioned under the two outermost layers in an opposite direction compared to the two outermost layers.

According to an embodiment of the invention the method comprises winding the conductor with at least six layers around a central wire.

According to an embodiment of the invention the method comprises extruding the inner semiconducting layer arranged directly on a longitudinal semiconducting tape arranged in contact with and around the outermost layer of the conductor.

The invention provides an extruded high voltage cable with an improved interface between the conductor and inner conducting layer, which results in considerable cost saving in manufacturing of the cable as well as reduced risk of having electrical breakdown in the insulation of the cable when testing the cable after production.

BRIEF DESCRIPTION OF THE DRAWING

The invention will be described in greater detail by description of embodiments with reference to the accompanying drawing, wherein.

DESCRIPTION OF PREFERRED EMBODIMENTS

Figure 1:
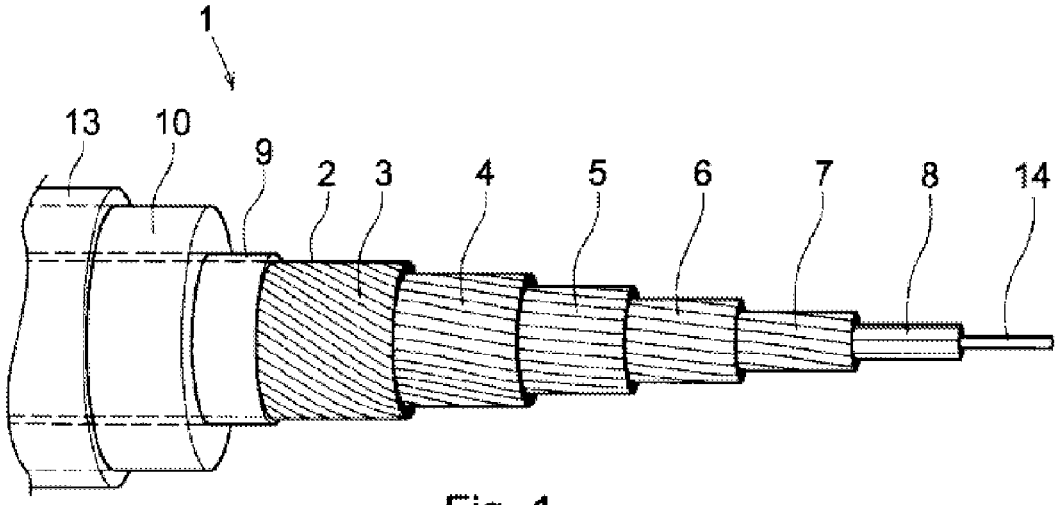
FIG. 1 shows an extruded high voltage cable according to one embodiment of the invention having the two outer layers of the conductor arranged in the same lay direction.
Figure 2:
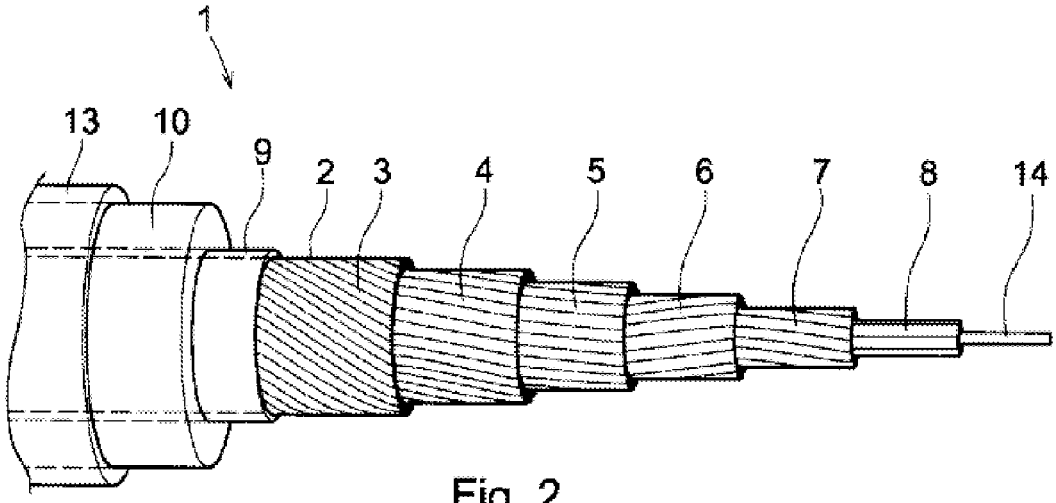
FIG. 2 shows an extruded high voltage cable according to one embodiment of the invention where one of the layers of the conductor underlying the two outermost layers are arranged in a different direction than the two outermost layers.

FIG. 1 shows a high voltage cable 1 comprising a concentric lay conductor 2. A single central wire 14 is surrounded by a first layer 8 of substantially straight wires. Around the first layer 8 five layers 3, 4, 5, 6, 7 of helically wound metal wires 11, 12 are arranged. The two outermost layers 3, 4 of the conductor are arranged in the same lay direction. In FIG. 2 the three layers 5, 6, 7 underlying the two outermost layers 3, 4 are arranged in the same lay direction as the two outermost layers. The two outermost layers 3, 4 are laid in a right-hand lay direction. The five layers 3, 4, 5, 6, 7 of helically wound wires extend through the length of the cable 1; however, to show the lay direction for each subsequent layer each layer in FIG. 1 has been cut of a distance at the end. An extruded inner conductive layer 9 is arranged concentrically around and in contact with a longitudinal semiconducting tape (not shown) that is arranged in contact with and concentrically around the outermost layer of the conductor. An insulation layer 10 and an outer conductive layer 13 are concentrically arranged around the inner conductive layer. Instead of a central wire with six surrounding wires in a first layer, a solid conductor or a hollow central conductor may be used.

During manufacturing of the concentric lay conductor 2 according to FIG. 1, a first layer 8 of metal wires is firmly arranged around a single central wire 14. A second layer 7 of metal wires is concentrically and helically wound around the first layer 8. A third layer 6 of metal wires is concentrically and helically wound around the second layer, and so on until a concentric lay conductor with five layers 3,4,5,6,7 of helically wound metal wires is manufactured.

The conductor 2 is compacted by a wire drawing type die or pairs of rollers for each layer of wires to avoid interstices in the conductor 2. When the conductor 2 has been compacted, it is fed through an extrusion die and an inner conducting layer 9, an insulation layer 10, and a concentrically extruded conducting layer 13 is extruded around the conductor 2, such that the inner conducting layer 9 is tightly fixed to the outermost layer of the conductor 2.

FIG. 2 shows the extruded high voltage cable 1 according to the above described exemplary embodiment in relation to FIG. 1 with the difference that one of the layers 5,6,7 underlying the two outermost layers 3,4 are arranged in an opposite lay direction compared to the lay direction of the two outermost layers 3,4.

Figure 3:
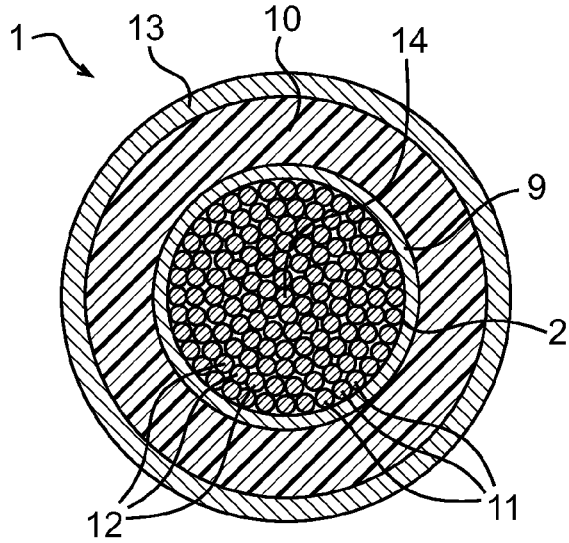
FIG. 3 is a cross-section of the extruded high-voltage cable in FIG. 1.

FIG. 3 shows a cross-section of the extruded high voltage cable 1 in FIG. 1. The cable comprises a conductor 2, where the conductor is a concentric lay conductor with five layers 3,4,5,6,7 of helically wound metal wires 11,12 around a first layer 8 of substantially straight wires arranged around a central wire 14. The six layers of helically wound wires 11, 12 extend through the length of the cable 1. An extruded inner conductive layer 9 is arranged concentrically around and in contact with a longitudinal semiconducting tape (not shown) that is arranged in contact with and concentrically around the outermost layer of the conductor. An insulation layer 10 is arranged concentrically around the inner conducting layer 9 and an outer conducting layer 13 is concentrically arranged around the insulation layer 10. Usually there are also protective layers (not shown), arranged concentrically around the outer conducting layer 13. All conducting, insulation and protective layers extend through the length of the cable.

Figure 4:
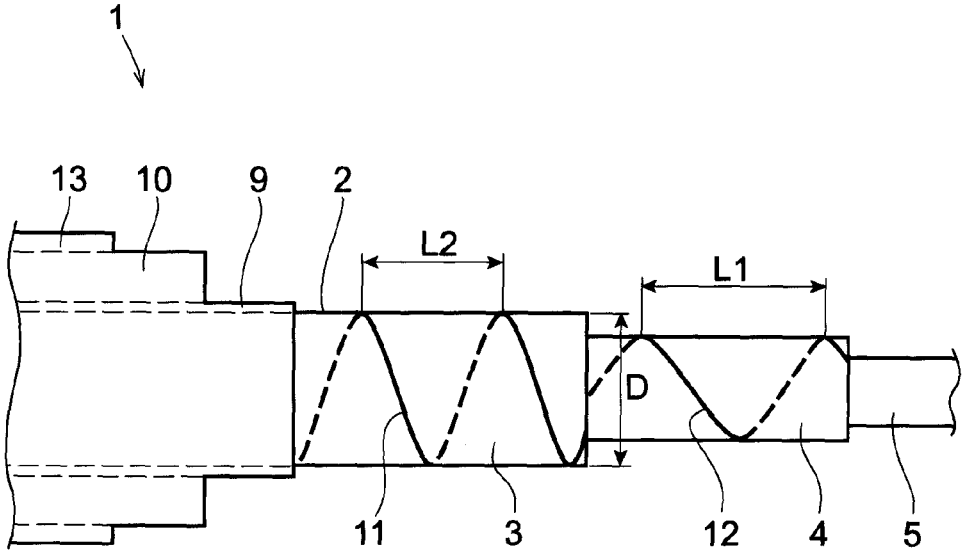
FIG. 4 shows a difference in lay length of the two outermost layers according to one embodiment of the invention.

FIG. 4 shows one exemplary embodiment of the invention where the length of lay L2 of the outermost layer 3 is shorter than the length of lay L1 of the second outermost layer 4. The difference (L1–L2) between the length of lay L2 of the outermost layer 3 and the length of lay L1 of the second outermost layer 4 is greater than, or equal to, two times the outer diameter D of the conductor. If, for example, the outer diameter D is 50 mm, the difference between the length of lay L2 of the outermost layer 3 and the length of lay L1 of the second outermost layer should be 100 mm, or greater than 100 mm, to give the wanted properties of the outer surface of the conductor. Only one of the wires 11, 12 in the two outermost layers is shown in FIG. 4. The layers 3, 4 in FIG. 4 have a right-hand lay. The layers underlying the three outermost layers 3, 4, 5 of the conductor are not shown in FIG. 4.

Since only certain preferred embodiments of the present invention have been described, many modifications and changes will be apparent to those skilled in the art without departing from the scope of the invention, such as this is defined in the appended claims with support from the description and the drawing.

For example, in the description only examples of extruded cables with a conductor with six layers of wires have been described, but the number of layers may depend on the required size of the conductor. Also the lay direction of the layers underlying the two outermost layers may be arranged in a different lay direction than according to the two examples described above.

The invention claimed is:

1. An extruded high voltage cable comprising:

a conductor with at least five concentric layers of helically wound metal wires, an extruded inner conducting layer surrounding the conductor, and an extruded electrical insulation arranged outside the inner conducting layer, wherein two outermost layers of the conductor have a same lay direction, wherein a length of lay of the outermost layer of the conductor is shorter than a length of lay of the second outermost layer of the conductor, and wherein a difference between the length of lay of the outermost layer of the conductor and the length of lay of the second outermost layer of the conductor is greater than, or equal to, two times an outer diameter of the conductor.

2. The extruded high voltage cable according to claim 1, wherein at least one layer of the conductor positioned inside the two outermost layers in the conductor is arranged with a lay direction in an opposite direction to the lay direction of the two outermost layers.

3. The extruded high voltage cable according to claim 1, further comprising:

a central conductor about which the layers of helically wound metal wires are wound, and a layer of substantially straight wires between the central conductor and the inner-most helically wound layer.

4. The extruded high voltage cable according to claim 1, wherein the conductor has a cross section larger than 700 $mm^2$.

5. The extruded high voltage cable according to claim 1, wherein the inner conducting layer is extruded directly on the conductor such that the inner conducting layer is in contact with the outermost layer of the conductor.

6. The extruded high voltage cable according to claim 1, wherein the inner conducting layer is extruded directly on a longitudinal semiconducting tape arranged around and in contact with the outermost layer of the conductor.

7. A method for manufacturing an extruded high voltage cable, comprising:

helically winding a conductor of at least five layers of metal wires, winding the conductor such that two outermost layers of metal wires are wound in a same lay direction, helically winding the two outermost layers of the conductor such that a length of lay of the outermost layer is shorter than a length of lay of the second outermost layer, winding the two outermost layers of the conductor such that a difference between the length of lay of the outermost layer and the length of lay of the second outermost layer is greater than or equal to two times an outer diameter of the conductor, extruding an inner conducting layer on an outer surface of the conductor, such that the inner conducting layer surrounds the conductor, and extruding an insulation layer, such that the insulation layer is arranged outside and circumferential to the inner conducting layer.

8. The method according to claim 7, further comprising:

compacting the conductor such that a diameter of the conductor is decreased.

9. The method according to claim 7, further comprising:

manufacturing the conductor by winding the layers of helically wound metal wires around a central conductor, and arranging a layer of substantially straight wires between the central conductor and an inner most helically wound layer.

10. The method according to claim 7, further comprising:

winding at least one of the layer of the conductor positioned under the two outermost layers in an opposite direction compared to the two outermost layers.

11. The method according to claim 7, further comprising:

extruding the inner conducting layer directly on the outermost layer the conductor.

12. The method according to claim 7, further comprising:

extruding the inner conducting layer directly on a longitudinal semiconducting tape arranged around and in contact with the outermost layer of the conductor.

* * * * *